US005606865A

United States Patent [19]

Caron

[11] Patent Number: 5,606,865

[45] **Date of Patent: *Mar. 4, 1997**

[54] PORTABLE AIR COOLER

[76] Inventor: Leofred Caron, 763 rue St-Francois, Edmundston, N. B., Canada, E3V 1H6

[ * ] Notice: The terminal 7 months of this patent has been disclaimed.

[21] Appl. No.: 274,257

[22] Filed: Jul. 13, 1994

[51] Int. Cl.[6] ..... F25B 27/00

[52] U.S. Cl. ..... 62/238.1; 62/DIG. 22; 62/260; 165/45

[58] Field of Search ..... 62/DIG. 22, 260, 62/238.1, 238.6; 165/16, 45, 46

[56] References Cited

U.S. PATENT DOCUMENTS

| | | | |
|---|---|---|---|
| 3,364,989 | 1/1968 | Marsteller | 165/122 |
| 3,492,833 | 2/1970 | Marsteller | 62/176 |
| 3,550,677 | 12/1970 | Knowles | 165/32 |
| 3,822,561 | 7/1974 | Miller | 62/157 |
| 5,046,329 | 9/1991 | Travis, III | 62/259.3 |

FOREIGN PATENT DOCUMENTS

| | | | |
|---|---|---|---|
| 407305 | 6/1932 | United Kingdom | 62/DIG. 22 |

*Primary Examiner*—John M. Sollecito
*Attorney, Agent, or Firm*—Mario D. Theriault

[57] ABSTRACT

A portable air cooler for installation near a kitchen or similar sink using tap water as a refrigerant. The portable air cooler comprises a fan and an air cooling coil at the inlet opening of the fan. The cooling coil comprises hose means to circulate a flow of cold water from the faucet of a kitchen sink, through the coil and back into the sink. The fan and the cooling coil are contained within a housing which has baffle means to expel air upwardly. The baffle means on the housing provides for mixing a naturally rising warm air with a naturally falling cold air within a room to be cooled. The still cold water flowing out of the cooling coil and into the kitchen sink cools the surface of the sink. The portable air cooler is adapted to generate an air circulation over the surface of the sink whereby warm air is pre-cooled before entering the fan. The kitchen sink is used as a heat exchanger in series with the cooling coil inside the unit to cool ambient air through the fan.

4 Claims, 3 Drawing Sheets

PORTABLE AIR COOLER

FIELD OF THE INVENTION

The present invention relates to portable air coolers, and in particulars to portable air coolers using tap water as a refrigerant.

BACKGROUND OF THE INVENTION

Air conditioners of the conventional type are generally electrically operated, having a fan, an evaporator coil containing a refrigerant, a compressor, condenser coil, an expansion valve for determining the refrigerant evaporating temperature, a thermostat, and an electrical control circuit. This type of equipment is normally enclosed within a rectangular cabinet. The dimensions of the cabinet are usually defined to provide an installation of the unit in a standard window opening, whereby the air from outside is forced through the evaporator coil and within the room. Other models of cabinet are designed for a permanent installation through a wall of a building.

Although the field of air conditioners is a mature art, and the efficiency of most commercial units is undisputable, the selling price of an air conditioner is not affordable by all. Likewise, it is not every home which has a window of proper dimensions to receive an air conditioner, and it is not every home owner who is willing to install a unit permanently through a wall of an apartment.

For those exceptions, relief from warm weather is generally obtained from fans which induce air movement and promote evaporation of moisture at the skin surface, providing thereby a cooling effect. Notwithstanding the fact that fans lessen the discomfort from warm weather, the air conditioner is a long leap ahead in controlling the temperature of an apartment. Unfortunately, the nature of the refrigerant remains a primary obstacle in reducing the cost of an air conditioner to please a larger number of users. The need for a compressor and evaporation equipment adds to the complexity and the selling price of those appliances.

Cold water from a house plumbing system is an abundant source of refrigerant. The cold water generally comes from deep in the ground where the temperature is relatively constant despite the warmth of the season.

Water is also priceless and nonperishable. Aside from the cost of pumping and treating it, water follows the natural cycle of evaporation and rain to recover its full properties and static energy. There are many homes in rural areas which pump their water from individual wells and where the filtering and treating of water is not needed. There are still numerous municipalities which do not treat their water either, and where the cost of pumping it is reduced from a gravity fed reservoir. For all these applications, cold water from a house's piping system is an attractive refrigerant to reduce the temperature of air passing through a fan.

SUMMARY OF THE INVENTION

In accordance with one aspect of the present invention, there is provided a fan with a water cooled coil across the air intake opening thereof. There is also provided a connecting means to circulate cold water from a faucet, into the water cooled coil and back into a kitchen or similar sink. The fan and the coil are mounted inside a housing. The dimensions of this housing are common to most appliances found on a kitchen counter. Thus, the appearance of this air cooler is normal to an installation of the unit near a kitchen sink. A handle is provided on this housing to carry the unit between uses.

According to another aspect of the present invention, the still cold water dripping from the return line of the cooling coil and into the kitchen sink cools the surface of the sink. The portable air cooler is set to draw air from over the sink. That is to generate an air circulation over the surface of the sink whereby warm air is pre-cooled before entering the fan. The kitchen sink is used as a heat exchanger in series with the water cooled coil inside the unit. For this purpose, the housing comprises an air intake opening on the side thereof.

As cold air tends to fall, the housing also comprises an air discharge opening which is baffled to expel cooled air in an upward direction whereby air conditioning is effected by mixing a naturally falling cold air with a naturally rising warm air within a room.

According to a further aspect of the present invention, there is provided a water connecting means on the air cooler which includes an outlet flexible hose, and an inlet flexible hose terminated by a resilient tapered sleeve. During installation, the sleeve is simply forced over and stretched lightly to seal around a faucet nozzle. The tapering of the sleeve makes it adaptable to a variety of different faucets and other water taps, without the need for using tools, fittings and adapters of any sort.

One advantage of the present invention consists in a quick and easy installation when needed, and an easy storage during colder days. The installation of the unit consists of setting it near a kitchen sink, connecting the resilient sleeve to the cold water faucet, laying the outlet hose into the sink and connecting the fan supply cord to an electrical outlet.

Another advantage of the present invention is in its ability to cold air passing through a fan without using a compressible refrigerant.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
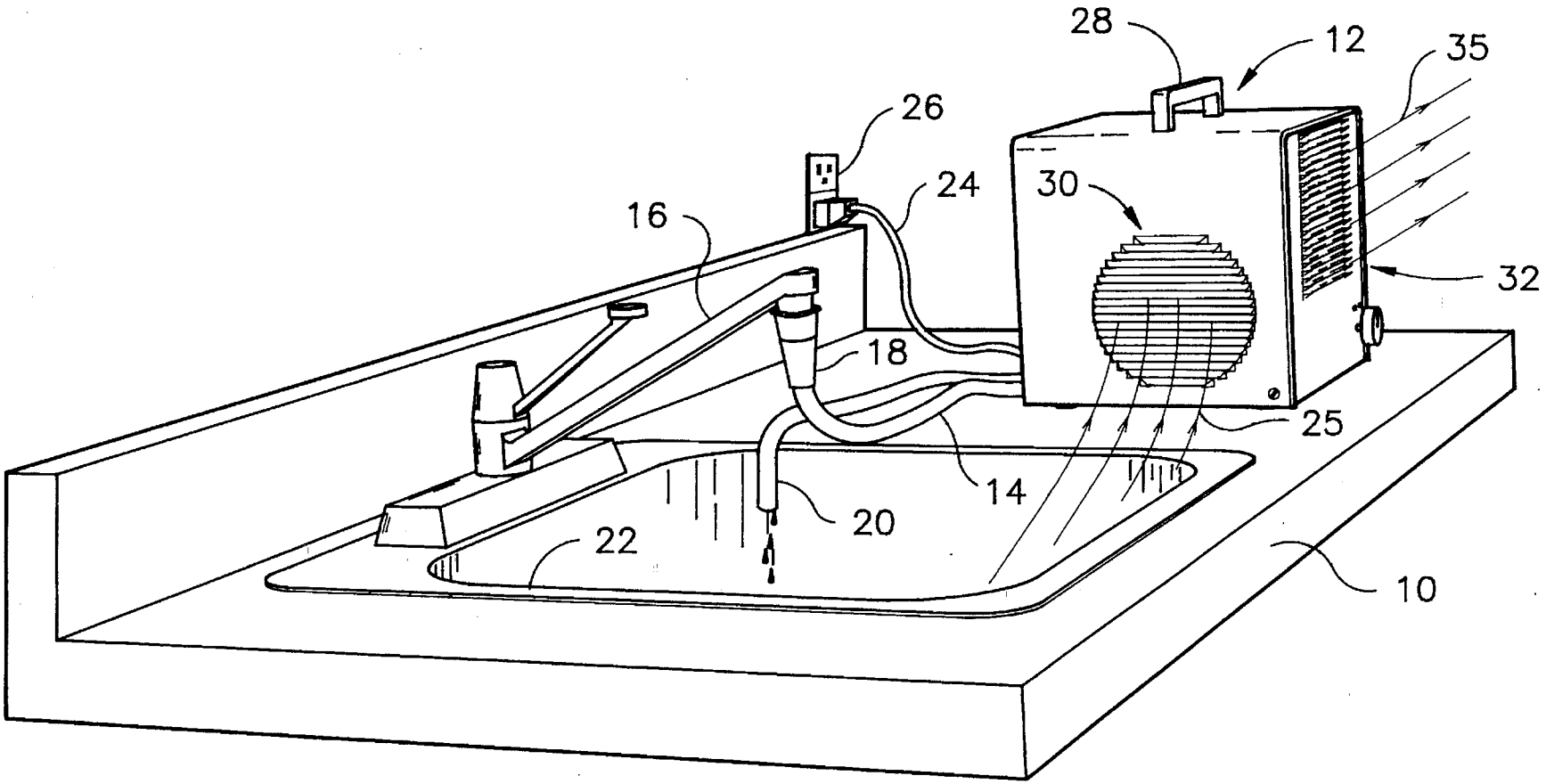
FIG. 1 is an illustration of a preferred embodiment of the invention installed on kitchen counter, near a kitchen sink.

Referring to FIG. 1, there is illustrated a kitchen sink 10 and a preferred embodiment of the invention 12 mounted thereat. The portable air cooler 12 has an inlet hose 14 connected to a faucet 16 by means of a tapered rubber sleeve 18. The portable air cooler 12 comprises also an outlet hose 20 which drains cold water into the kitchen sink 22, when the faucet 16 is partially opened to let a stream of cold water circulate through the air cooler 12.

The portable air cooler 12 comprises an electrically operated fan. A power cord 24 is provided to energize the fan from an electrical outlet 26.

The resilient tapered sleeve 18 is particularly convenient to connect hose 14 to faucets of various dimensions. An upward pushing of the sleeve 18 over the nozzle of the faucet 16 stretches the sleeve 18, causing it to seal around the tip of the nozzle. The sleeve 18 is preferably made of malleable rubber, soft plastic or other similar stretchy material. The resilient sleeve 18 is also specifically convenient to provide easy disconnecting to get drinking water or to obtain full use of the kitchen sink for its intended purpose.

Although FIG. 1 illustrates a tapered sleeve 18 to connect the inlet hose 14 to a water tap 16, other means of connecting such a threaded fitting or a quick disconnect coupling would also provide adequate connection to satisfy a proper operation of the air cooler 12.

The preferred embodiment of the invention comprises an air intake opening 30 which is baffled with a series of blades 36. Hence, when the air cooler 12 is placed on a kitchen counter 10 near a kitchen sink 22, air will be drawn from over the sink 22. The water coming out of the drain hose 20 is still sufficiently cold to cool the surface of the sink whereby the air moving over that surface will be cooled also before it mixes with air drawn into the intake opening 30 of the fan. Lines 25 represent the direction of the flow of air circulated through the fan entering the intake opening 30.

In this application, air receives a first cooling effect from a portion thereof passing over the surface of the sink, and a second cooling effect when it passes through a cooling coil within the air cooler 12.

Figure 2:
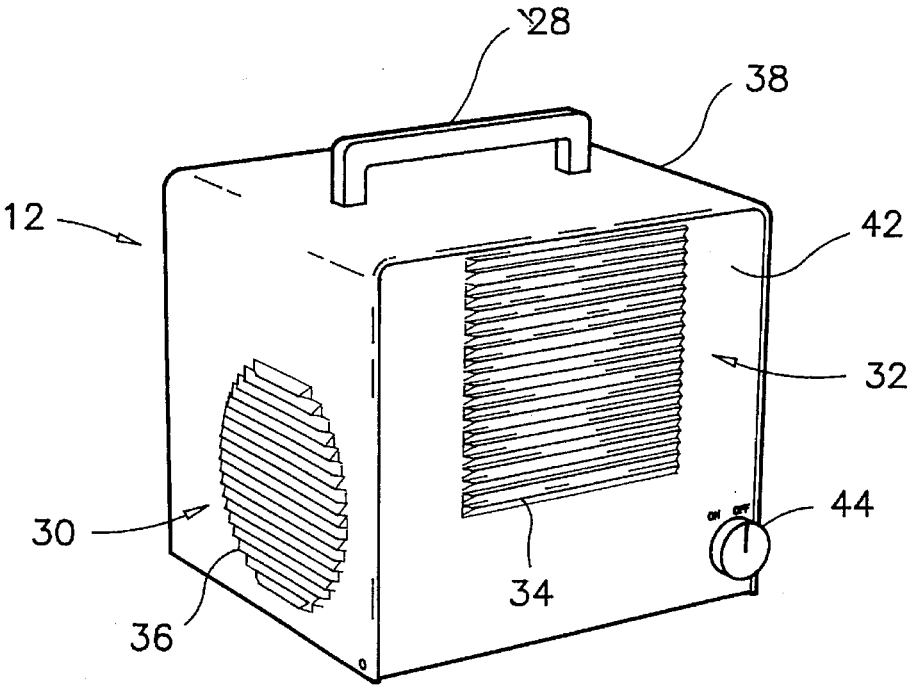
FIG. 2 illustrates a front view of the portable air cooler.
Figure 3:
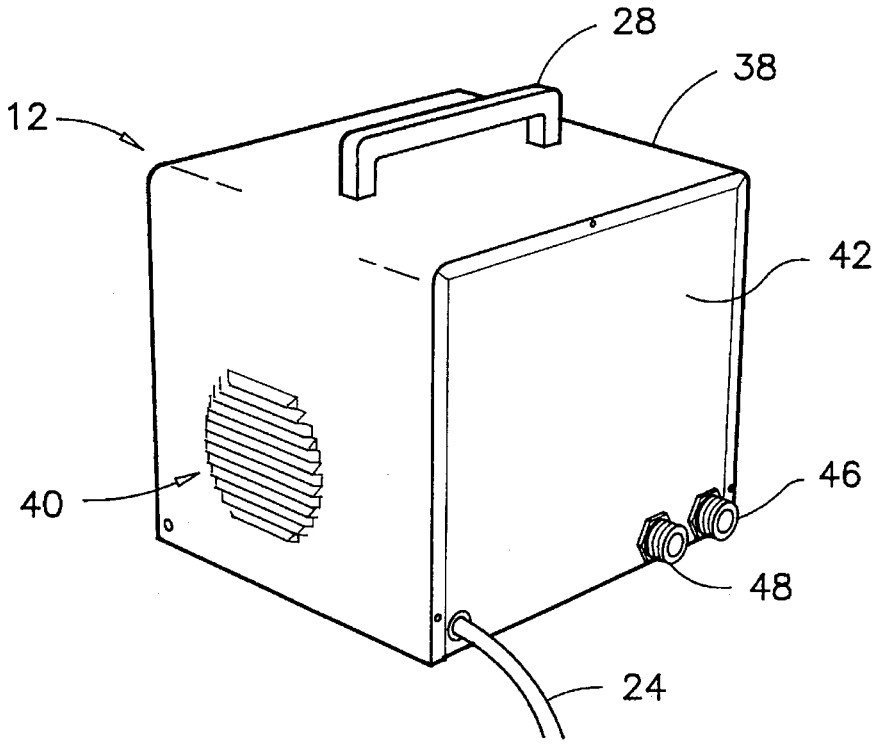
FIG. 3 illustrates a rear view of the portable air cooler.

Referring now to FIGS. 2 and 3, there is illustrated a portable air cooler 12 which has a housing made in two parts. A first skin 38 covers three surfaces of a cubical configuration including the uppermost surface and two side surfaces. This cover 38 has the air inlet opening 30 on one side and a motor breathing opening 40 on the opposite side thereof. The cover 38 holds the handle 28 for transporting the unit.

Although the preferred embodiment illustrated is made for an installation on the right side of a kitchen sink, the air inlet opening 30 and the motor breathing opening 40 are interchanged with one another on those models for an installation on the left side of a kitchen sink.

A lower part 42 of the housing of the portable air cooler 12 covers also three surfaces of a cubical configuration including a front, a rear and a bottom portions. The front portion of the housing is characterized by an air discharge opening 32 and an on-off control knob 44. The air discharge opening 32 comprises a series of baffling blades 34 which are oriented upwardly such that the cold air expelled from the portable air cooler 12 mixes with warm air in an upper part of the room. Lines 35 of FIG. 1 represent the direction of the flow of air blown from the portable air cooler 12.

The rear portion of the lower part 42 of the housing features the inlet fitting 46 and the outlet fitting 48 to the cooling coil of the air cooler 12, and the entry point for the electrical supply cord 24.

The dimensions of the cover 38 and of the lower part 42 define a cubical housing having side lengths of about 8" to about 10". These dimensions are common to most appliances and articles found on a kitchen counter such as a toaster, a kettle, a blender, or a flour can. Hence a portable air cooler having those dimensions is compatible to the space available on a kitchen counter for use and during storage of the apparatus.

Figure 4:
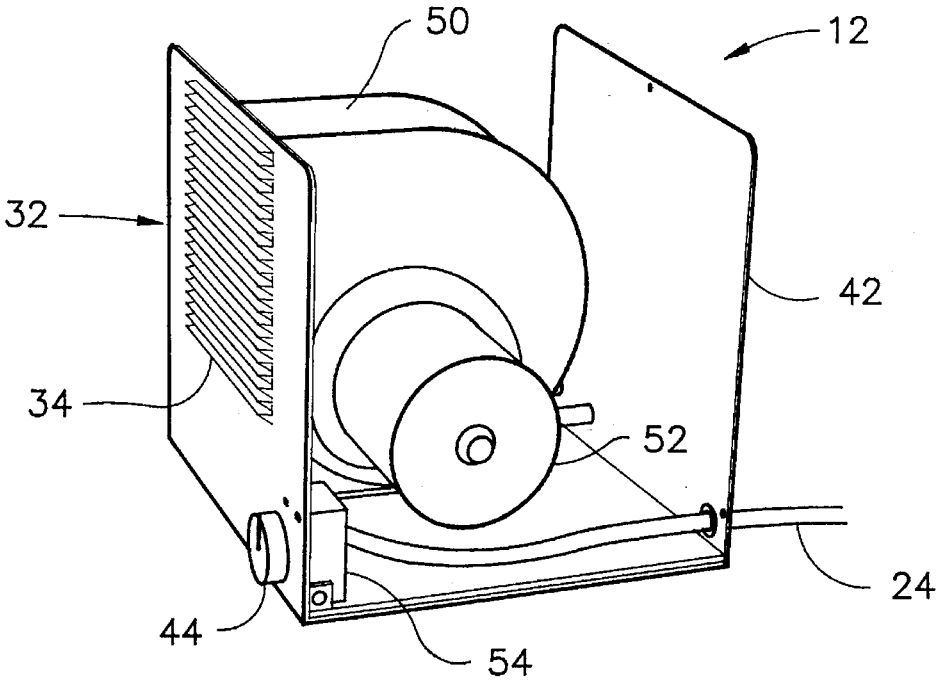
FIG. 4 is a front and right side view of the portable air cooler with the cover removed.
Figure 5:
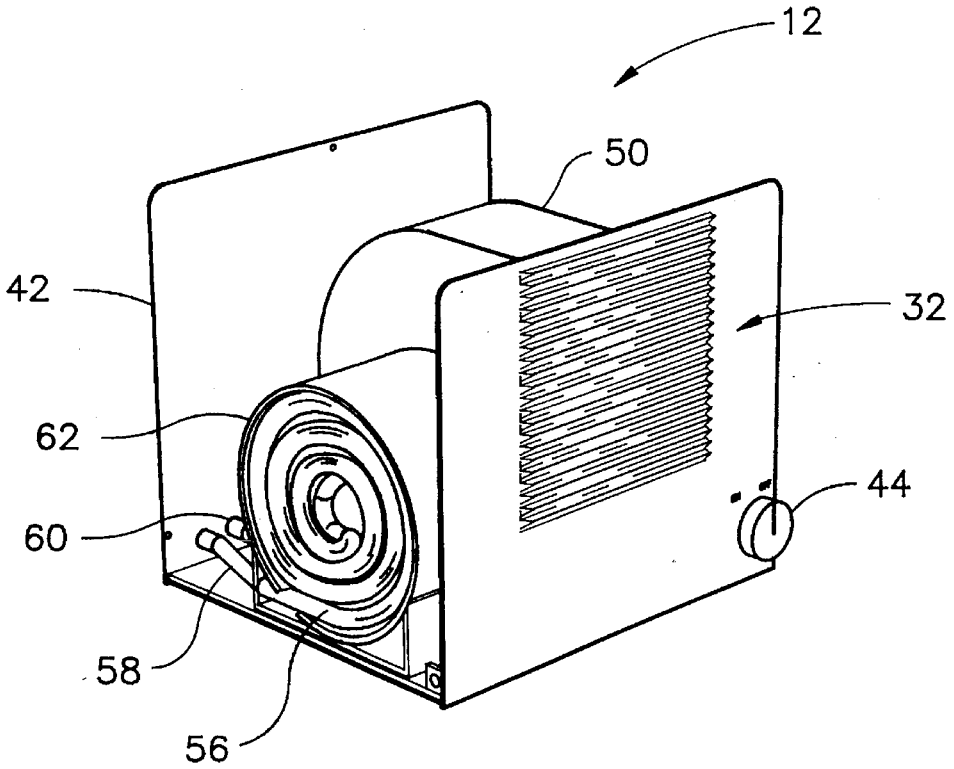
FIG. 5 is a front and left side view of the portable air cooler with the cover removed.

Referring now to FIGS. 4 and 5, there is illustrated a portable air cooler 12 with the cover 38 removed. A centrifugal fan 50, driven by an electric motor 52 is contained within the housing to draw air from the air inlet opening 30, and to expel air through the outlet opening 32.

The on-off knob 44 of the preferred embodiment activates an on-off switch 54 inside the enclosure of the portable air cooler 12.

A cooling coil 56 preferably made of ¼" I.D. copper or aluminum tubing, and preferably having 16 to 25 feet in length, is wound across the intake opening of fan 50. This coil 56 provides the cooling means for cooling the air being recirculated through the portable air cooler 12.

Both ends 58, 60 of the cooling coil 56 are connected respectively to fittings 46 and 48 of FIG. 3, such that cold water from the inlet hose 14 is circulated through the coil 56 and out into drain hose 20.

The cooling coil 56 is also preferably enclosed within an inlet duct 62 whereby incoming air is forced through the layers and rounds of coil 56 to improve heat exchange.

In use, the recommended flow of cold water from a faucet is approximately 3 gallons per hour for a portable air cooler having a coil of ¼" I.D. copper tubing by 16 feet long, and a fan capacity of 100 CFM. The results to be expected from such installation with a cold water temperature of 44° F. and a room temperature of 75° F., are that the water temperature flowing from the coil will be at about 56° F., and the air blown from the fan will be at about 72°–73° F.

While the preferred embodiment of the invention has been described as a portable air cooler for installation near a kitchen sink, other utilizations with other cold water sources are possible without altering the structure of the invention.

Therefore, the preferred embodiment of the invention as described therein is not limited thereto, and it will be apparent to those skilled in the art of air coolers, that numerous modifications form part of the present invention insofar as they do not depart from the spirit, nature and scope of the claimed and described invention.

I claim:

1. A portable air cooler for installation near a kitchen or similar sink comprising;

a fan having an air intake opening and an air discharge opening, a cooling coil mounted across said air intake opening, piping means to connect a cold water faucet of said kitchen or similar sink, to said cooling coil and from said cooling coil back into said sink, said cold water faucet being adapted to permit a flow of cold water through said piping means, whereby air drawn by said fan is cooled by heat transfer with said cooling coil before entering said fan, and wherein said air intake opening of said fan faces said sink when said portable air cooler is oriented in an operating position such that a portion of said air drawn toward said fan is cooled by heat transfer with a surface of said sink wetted by a flow of dripping water therein from a return of said piping means.

2. A portable air cooler as claimed in claim 1 comprising;

baffling means on said air discharge opening of said fan to guide cooled air forced out of said fan towards a high portion of said room, whereby air conditioning is effected by mixing a naturally falling cold air with a naturally rising warm air within said room.

3. A portable air cooler as claimed in claim 2 having;

a housing containing said fan and said cooling coil, wherein said air intake opening and said baffling means on said air discharge opening comprises a series of blades and slots formed on a respective surface of said housing.

4. A portable air cooler as claimed in claim 3 wherein, said housing has a cubical configuration with each side having a length of between about 8" to about 10".

* * * * *